United States Patent [19]

Sheriff

[11] Patent Number: 4,744,380

[45] Date of Patent: May 17, 1988

[54] ANIMAL FECES DISPOSAL APPARATUS

[76] Inventor: David G. Sheriff, 932 Rosedown La., Lafayette, La. 70503

[21] Appl. No.: 17,724

[22] Filed: Feb. 24, 1987

[51] Int. Cl.[4] ..... B08B 3/02

[52] U.S. Cl. ..... 134/198; 239/288; 241/169.2; 401/137

[58] Field of Search ..... 134/93, 182, 183, 198, 134/199, 201; 239/288, 288.3, 288.5; 294/1.3, 1.4; 241/168, 169.2; 401/137

[56] References Cited

U.S. PATENT DOCUMENTS

| | | | |
|---|---|---|---|
| 832,475 | 10/1906 | George | 401/137 X |
| 2,304,257 | 12/1942 | Jilbert | 401/137 X |
| 3,352,340 | 11/1967 | Hulterstrum | 241/169.2 |
| 3,464,629 | 9/1969 | Peters | 239/288.3 X |
| 3,770,204 | 11/1973 | Schuster | 134/183 X |
| 4,302,040 | 11/1981 | Lazar | 239/288 |

*Primary Examiner*—Philip R. Coe
*Attorney, Agent, or Firm*—James H. Beusse

[57] ABSTRACT

Improved apparatus for disposing of fecal matter with pressurized water. The apparatus includes a chamber which covers animal remains and a screen mesh which separates the remains into small pieces sufficient for rapid dissolving under the chamber with a water spray.

5 Claims, 1 Drawing Sheet

ANIMAL FECES DISPOSAL APPARATUS

FIELD OF THE INVENTION

This invention relates in general to waste disposal and in particular to a spray assembly adapted for dissolving animal excretia into soil.

BACKGROUND OF THE INVENTION

An inconvenience and awkward disposal problem is the removal of animal feces, particularly matter left on park lands, in gardens and in green areas which border sidewalk and roadways. Aside from the aesthetically undesirable aspects of picking up such matter from the ground, prior procedures for removing fecal matter have been inefficient and have posed potential health concerns.

Notwithstanding the development of pickup devices for animal excretia, prior means of removing fecal matter remain aesthetically undesirable, inefficient and potentially hazardous to human health. In particular it is noted that caretakers and public employees charged with the task of disposing large quantities of fecal matter often collect such matter, thus concentrating large amounts of the matter in small areas, creating potential health and disposal problems. In addition, the task of picking up such matter and depositing it in carry along receptacles for later disposal is inefficient and aesthetically undesirable labor even for pet owners.

Although some prior devices have been developed for removal of small quantities of fecal matter left by pets, e.g. see U.S. Pat. Nos. 3,740,086 and 4,383,710, such devices referred to at times as "pooper scoopers", have been based on the idea of picking the waste matter up and transferring it to a receptacle. The task of picking such matter up is made difficult, as noted in U.S. Pat. No. 4,383,710, by watery consistencies which also require rinsing of surfaces after the bulk of the matter is picked up.

Prior means of removal fecal matter by pressurized sprays, which dissolve the substances in water for subsequent absorption into the ground, are characterized by the visually undesirable feature of openly spraying fecal remains with a hose nozzle. Another disadvantage of this approach is that the remains splash or move about on the ground in response to the force of the water spray rather than breaking down into dissolvable pieces. In the past this spray approach has been particularly inefficient with dry animal feces which develop water impermeable surfaces and are more resistant to being broken down and dissolved. It is therefore desirable to have a covered device which confines the pressurized spray and separates the fecal matter into small pieces, thus limiting the movement of the deposits as well as rendering the spray process more effective.

SUMMARY OF THE INVENTION

Among the several objects of the present invention may be noted the provision of an improved device for dissolving fecal matter with water which overcomes the above discussed disadvantageous or undesirable features of the prior art, the provisions of such improved device being useful for caretakers and public works personnel undertaking the task of removing fecal matter which has been deposited in numerous locations on park lands, in gardens and in green areas which border sidewalks and city streets; the provisions of such improved device including a means for containing fecal matter within a controlled area while being dissolved by water pressure; the provisions of such improved device including a controlled means for breaking dry surfaces of fecal remains in order to overcome water impermeable properties which heretofore have reduced the efficiency and effectiveness of dissolving fecal remains into the ground; the provisions of such improved invention including a portable reservoir for dissolving limited quantities of animal feces when the device is not connected to a water supply; the provisions of such improved device being suitable for all consistencies of fecal waste.

In general, a spray device is provided for dissolving fecal remains into the ground, the device including a chamber which covers the remains while the remains are being dissolved by a water spray. Another novel feature of the inventive device is the provision of mechanical means to separate the remains into small pieces sufficient for rapid dissolving.

DETAILED DESCRIPTION OF THE PREFERRED EMBODIMENT

Figure 1:
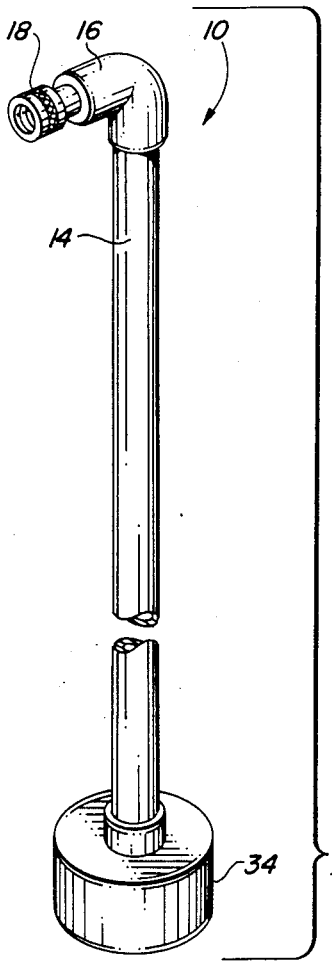
FIG. 1 is a side view of the inventive fecal disposal device.

With reference to the drawings in general, there is shown in one form of the invention a device for controllably dissolving fecal remains in the soil. The device 10 comprises an elongated tube 14 having at one and "L" shaped coupling pipe 16 with a threaded hose connection 18. Coupling pipe 16 is suitable for holding the device 10 in a vertical position during operation. The other end of tube 14 is connected to a diffusing spray nozzle 28. When water enters the device 10 by means of a hose attached at connection 18, valve 30 controls the spray of water through nozzle 28.

Figure 2:
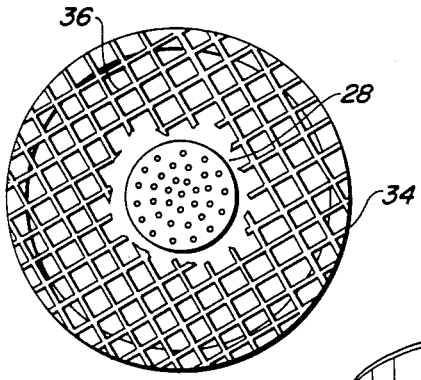
FIG. 2 illustrates the inventive chamber, diffusing nozzle and mesh screen of the device.
Figure 4:
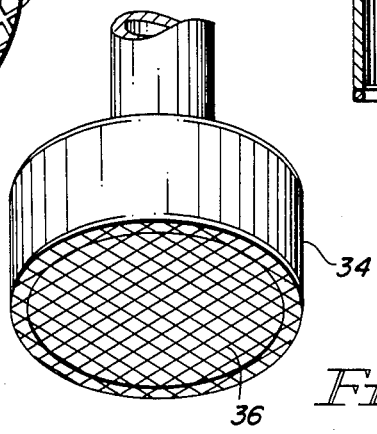
FIG. 4 is a partial perspective view of the apparatus of FIG. 1.

In the preferred embodiment illustrated in FIGS. 1 and 2 chamber 34 covers nozzle 28 so that water sprayed from the nozzle is confined to a substantially closed volume when the device is in an upright position. Another novel feature of the invention is a means for separating the fecal matter into smaller pieces and enhancing the dissolving process. In the preferred embodiment the lower end of chamber 34 is covered with a heavy mesh screen 36. The inventor has found ¼ inch gridwork to be suitable for effective operation of the invention. Other separating means such as a plurality of cutting edges may be used in place of a screen.

In operation, valve 30 is controllable by an operator's foot so that when an operator places the device over a fecal deposit, the weight of the foot on the valve simultaneously turns on the spray and mashes the fecal deposit. The combination of the pressurized spraying and formation of small pieces result in efficient dissolving of fecal matter into the ground.

Figure 3:
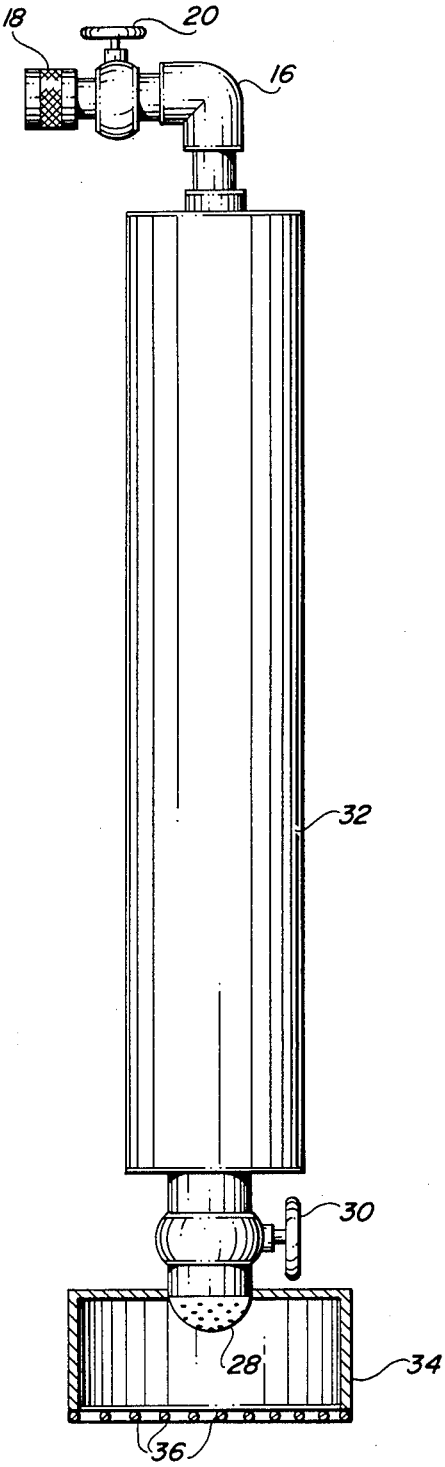
FIG. 3 illustrates an alternate embodiment of the inventive fecal disposal device.

In an alternate embodiment illustrated in FIG. 3, tube 14 has been replaced with a reservoir 32 for storing a sufficient quantity of water for washing away at least a single deposit of fecal matter when the device is disconnected from a water supply hose. The inventor has found this portable feature to be useful when the device must be used in areas remote from a water supply and when the device is to be used for occasional cleanups. When using the device without a supply hose, reservoir 32 is filled and valve 20 is closed until the device is to be used. This prevents leakage of water from hose connection 18. When using the device without a water supply hose, valve 20 is re-opened prior to opening valve 30.

The inventive device may be constructed from any of numerous materials well known in the art including metals and plastics. In the preferred embodiment, the device is constructed from common polyvinyl chloride (PVC) pipes and fittings. Nozzle 28 may be formed from a drilled PVC end cap of the type commonly used to cover pipe ends.

The foregoing description of the preferred embodiment has been presented in order to illustrate the principles of the invention and it should be appreciated that numerous modifications and changes will readily occur to those skilled in the art. Therefore the invention is not to be considered in any way limited by the description as illustrated above but is to be limited only by the scope of the claims.

I claim:

1. Apparatus for disposing of animal feces comprising:

(a) a rigid tube having a first end and a second end;

(b) connection means attached to said first end for enabling connection of said tube to a water source;

(c) a diffusing spray nozzle attached to said second end of said tube;

(d) an enlarged chamber connected to said second end of said tube and encompassing said nozzle, said chamber having a substantially flat open end opposite said nozzle; and (e) a gridwork positioned over the open end of said chamber for separating a deposit of feces into small pieces for enhancing its dissolvability when said chamber is positioned about the deposit.

2. The apparatus of claim 1 wherein said gridwork comprises a mesh screen.

3. The apparatus of claim 2 wherein said tube includes a first valve to control water flow through said nozzle.

4. The apparatus of claim 3 wherein said tube further comprises:

(a) a second valve adjacent said second end of said tube for controlling the flow of water from said tube; and (b) a reservoir for holding a sufficient quantity of water to wash away at least one deposit of feces.

5. The apparatus of claim 4 wherein said reservoir comprises an enlarged section of said tube.

* * * * *